US009689219B2

(12) United States Patent
Frosell et al.

(10) Patent No.: US 9,689,219 B2
(45) Date of Patent: Jun. 27, 2017

(54) METHODS FOR AUTONOMOUSLY ACTIVATING A SHIFTING TOOL

(71) Applicant: Halliburton Energy Services, Inc., Houston, TX (US)

(72) Inventors: Thomas J. Frosell, Irving, TX (US); Mark Douglas Macek, Burlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/780,979

(22) PCT Filed: Apr. 25, 2013

(86) PCT No.: PCT/US2013/038228
§ 371 (c)(1),
(2) Date: Sep. 28, 2015

(87) PCT Pub. No.: WO2014/175890
PCT Pub. Date: Oct. 30, 2014

(65) Prior Publication Data

US 2016/0053562 A1 Feb. 25, 2016

(51) Int. Cl.

| | |
|---|---|
| ***E21B 23/04*** | (2006.01) |
| ***E21B 34/14*** | (2006.01) |
| ***E21B 23/00*** | (2006.01) |
| *E21B 34/00* | (2006.01) |

(52) U.S. Cl.
CPC ..... *E21B 23/04* (2013.01); *E21B 23/00* (2013.01); *E21B 34/14* (2013.01); *E21B 2034/007* (2013.01)

(58) Field of Classification Search
CPC .... E21B 2034/007; E21B 23/00; E21B 23/04; E21B 34/14
See application file for complete search history.

(56) References Cited

U.S. PATENT DOCUMENTS

| | | | | |
|---|---|---|---|---|
| 4,436,152 | A | 3/1984 | Fisher et al. | |
| 4,928,772 | A * | 5/1990 | Hopmann | E21B 34/14 166/332.1 |
| 5,090,481 | A | 2/1992 | Pleasants et al. | |
| 5,183,114 | A | 2/1993 | Mashaw, Jr. et al. | |
| 5,305,833 | A | 4/1994 | Collins | |
| 5,549,161 | A | 8/1996 | Gomez et al. | |

(Continued)

FOREIGN PATENT DOCUMENTS

GB 2213181 A 9/1989

OTHER PUBLICATIONS

International Search Report and Written Opinion date mailed Jan. 17, 2014; PCT International Application No. PCT/US2013/038228.

(Continued)

*Primary Examiner* — James G Sayre
(74) *Attorney, Agent, or Firm* — McGuireWoods LLP

(57) ABSTRACT

A method for activating a shifting tool comprises introducing a shifting tool in a desired wellbore zone where it is exposed to a pre-determined hydrostatic pressure. The shifting tool comprises at least one key that is configured to be expanded and released from a retracted position when the shifting tool is subjected to the pre-determined hydrostatic pressure.

25 Claims, 5 Drawing Sheets

(56) References Cited

U.S. PATENT DOCUMENTS

| | | | | |
|---|---|---|---|---|
| 6,199,632 | B1 * | 3/2001 | Shy | E21B 23/04 166/212 |
| 7,556,102 | B2 | 7/2009 | Gomez | |
| 7,712,538 | B2 | 5/2010 | Fay | |
| 8,141,648 | B2 | 3/2012 | Darnell et al. | |
| 8,870,153 | B2 * | 10/2014 | Ross | E21B 34/103 166/323 |
| 9,068,413 | B2 * | 6/2015 | Doane | E21B 23/04 |
| 2007/0144731 | A1 * | 6/2007 | Murray | E21B 23/00 166/120 |
| 2007/0187115 | A1 * | 8/2007 | Read | E21B 23/00 166/386 |
| 2011/0030975 | A1 * | 2/2011 | Duphorne | E21B 23/006 166/386 |
| 2012/0067583 | A1 | 3/2012 | Zimmerman et al. | |
| 2016/0032670 | A1 * | 2/2016 | Webster | E21B 23/004 166/381 |

OTHER PUBLICATIONS

Halliburton; Enhanced Single-Trip Multizone (ESTMZ) System; Halliburton Paper; Jul. 2014.

* cited by examiner

METHODS FOR AUTONOMOUSLY ACTIVATING A SHIFTING TOOL

TECHNICAL FIELD

A shifting tool and methods for activating the shifting tool are provided. The shifting tool includes a piston and at least one key held in an initial retracted position during running of the tool into a wellbore. According to an embodiment, the shifting tool is used in an oil or gas well operation. The piston can be activated at a pre-determined hydrostatic pressure. The activation of the piston can allow the key to be released and expanded.

SUMMARY

According to an embodiment, a shifting tool for use in a wellbore comprises: a piston configured to be autonomously activated at a pre-determined hydrostatic pressure, wherein a desired zone in the wellbore exerts a hydrostatic pressure greater than or equal to the pre-determined hydrostatic pressure; at least one piston restraining device coupled to the piston, wherein the piston restraining device is configured to break, shear, or compress at the pre-determined hydrostatic pressure; and at least one key coupled to the piston, wherein the at least one key is operatively maintained in a retracted position when the piston is maintained in the first position, wherein the piston is in the first position prior to and during introduction of the shifting tool in the desired wellbore zone, wherein the breaking, shearing, or compression of the at least one piston restraining device at the pre-determined hydrostatic pressure shifts the piston from the first position to a second position, and wherein the at least one key is expandably released from the retracted position when the piston is in the second position.

According to another embodiment, a method of activating a shifting tool in a wellbore comprises: activating a piston autonomously at a pre-determined hydrostatic pressure, wherein the shifting tool comprises the piston and at least one key positioned adjacent the piston; and allowing the key to move from the first position to a second position during the step of activating the piston.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
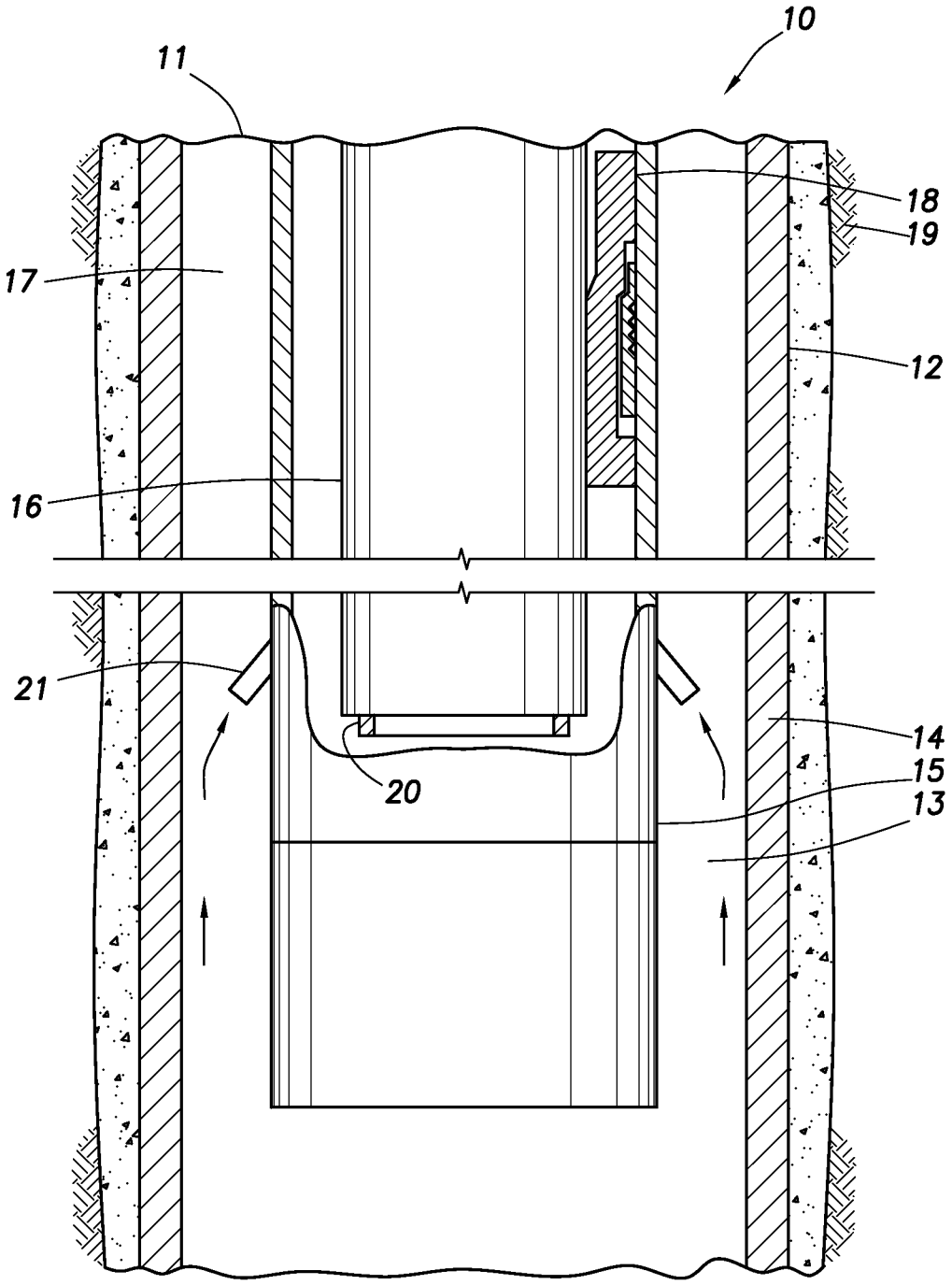
FIG. 1 depicts a well system containing a shifting tool.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more positions, components, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, an injection well, or a geothermal well. As used herein, a "well" includes at least one wellbore. The wellbore is drilled into a subterranean formation. The subterranean formation can be a part of a reservoir or adjacent to a reservoir. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

A wellbore segment can have a specific hydrostatic pressure. The hydrostatic pressure in the wellbore segment can be pre-determined. As used herein, "hydrostatic pressure" is the force per unit area exerted by a column of wellbore fluid at rest. In U.S. oilfield units, hydrostatic pressure is calculated using the equation: P=MW*Depth*0.052, where MW is the drilling fluid density in pounds per gallon, Depth is the true vertical depth or "head" in feet, and 0.052 is a unit conversion factor chosen such that P results in units of pounds per square inch (psi). The hydrostatic pressure is the force exerted on the wellbore components, such as a tubing string or casing, or a subterranean formation for an open-hole wellbore portion, via the fluid located in the wellbore.

As used herein, the term "autonomous" means the shifting tool is designed to be automatically activated without any human or other external intervention. For example, the pre-determined hydrostatic pressure can break, shear, or compress a piston restraining device coupled to the piston, that allows the piston to move from the first position to a second position, thereby automatically shifting the piston without any external mechanical or hydraulic intervention.

The process involved in preparing a wellbore for producing oil or gas from the reservoir is commonly known as well completion. A tubing string is commonly run into the wellbore such that produced oil and gas hydrocarbons can flow into the tubing string and towards the wellhead. A shifting tool can be used in a variety of applications. Shifting tools, commonly referred to as shifters, are used in the art to actuate, move, install, and retrieve downhole tools and parts. For example, during well completion operations, various downhole service tools, including but not limited to fluid flow control devices, wellbore isolation devices and the like may be permanently or retrievably installed in the wellbore. As used herein, the term "downhole service tools" includes tools, systems, equipment and components that may be used in a wellbore, for example for use in well completion operations. While permanent devices are generally designed to remain in the wellbore after use, retrievable devices are capable of being removed after use. Traditionally, a retrieval tool is inserted into the wellbore, wherein the retrieval tool can contain one or more keys that engage with one or more corresponding recesses on the device to be retrieved or installed at the bottom of the wellbore. After engagement with the recesses, the device to be retrieved or installed is then positioned in or removed from the wellbore.

By way of another example, shifting tools can be used to open or close a valve. Well completion can also include the creation of hydraulic openings or perforations through the production casing string, the cement, and a short distance into the desired formation or formations so that produced oil or gas fluids can flow into the wellbore or wellbore fluids can flow from the wellbore into the formation. The completion process may also include installing a production tubing string within the well casing which is used to produce the well by providing the conduit for formation fluids to travel from the formation depth to the surface. In order to selectively permit or prevent fluid flow into or from the production tubing string, one or more valves can be located within the tubing string. Typical valves comprise a generally tubular body portion having side wall inlet openings formed therein and a sliding sleeve coaxially and slidably disposed within the body portion. The sleeve is operable for axial movement relative to the body portion between a closed position, in which the sleeve blocks the body inlet ports and fluid flow, and an open position, in which the sleeve uncovers the ports to permit fluid flow. The sliding sleeves thus function as movable valve elements operable to selectively permit or prevent fluid flow.

A shifting tool can include one or more keys that mate with corresponding recesses on a sliding sleeve. After mating, the shifting tool can be utilized to shift selected sliding sleeves from their closed positions to their open positions, or vice versa, in order to provide subsurface flow control in the well.

Shifting tools can be lowered into the interior of a tubing string by a variety of means, such as a wireline, slickline, jointed pipe, or coiled tubing. However, during the running of the shifting tool, the keys protrude from the body of the tool. The protruding keys can make running difficult or impossible because the keys can catch on other wellbore components. In order to overcome the problems associated with protrusion of the keys during running, the keys can be held in a retracted, rotated, or declined position during running of the tool. After the tool is positioned in the desired segment of the wellbore, the shifting tool can become activated whereby the keys are released from the retracted, rotated, or declined positions. Previous attempts to activate a shifting tool include applying an external pressuring or mechanical means to the tool wherein the keys are released. Shifting tools can also be activated by hydraulic means or by other physical means including actuating components present inside the wellbore. The external means frequently require human intervention at the rig floor or other location.

Some of the disadvantages to using previous methods to activate the shifting tool include: the use of an external means to activate the shifting tool and the added resources, such as, expense and time associated with providing the external means; the unpredictable nature of the external means thereby making it difficult to accurately control the activation of the shifting tool; the premature activation of the shifting tool during the introduction of the shifting tool into a wellbore or during the installation of a completion tool at the bottom of the wellbore; and a more complex system requiring other mechanical components to activate the tool. The premature activation of the shifting tool can cause undesirable consequences. By way of example, the premature activation of the shifting tool may result in a premature or arbitrary opening or closing of the sliding sleeves before a desired wellbore zone is reached, inefficient retrieval of downhole service tools and inappropriately positioned downhole service tools. Therefore, there remains a need for an improved shifting tool and an improved method for activating the shifting tool.

A novel method for activating a shifting tool, comprises a piston and at least one key. The shifting tool is activated using the pre-determined hydrostatic pressure in a desired wellbore zone to autonomously shift or move the piston from the first position to a second position. The key can be coupled to the piston and can be held in first position during the introduction of the shifting tool into the desired wellbore zone. The autonomous movement of the piston to a second position can allow the key to move from the first position to a second position. The key in the second position can then engage with and move a sliding sleeve or engage with a recess or a mating profile in a downhole service tool to move/position it in the wellbore. As used herein, a "desired zone in the wellbore" or the term "desired wellbore zone" is any interval or segment of the wellbore where the shifting tool is to be positioned, having a particular depth and an associated hydrostatic pressure. In some instances, the desired wellbore zone can be the bottom of the wellbore or risers in offshore applications.

According to an embodiment, a shifting tool for use in a wellbore comprises: a piston configured to be autonomously activated at a pre-determined hydrostatic pressure, wherein a desired zone in the wellbore exerts a hydrostatic pressure greater than or equal to the pre-determined hydrostatic pressure; at least one piston restraining device coupled to the piston, wherein the piston restraining device is configured to break, shear, or compress at the pre-determined hydrostatic pressure; and at least one key coupled to the piston, wherein the at least one key is operatively maintained in a retracted position when the piston is maintained in first position, wherein the piston is in the first position prior to and during introduction of the shifting tool in the desired wellbore zone, wherein the breaking, shearing, or compression of the at least one piston restraining device at the pre-determined hydrostatic pressure shifts the piston from the first position to a second position, and wherein the at least one key is expandably released from the retracted position when the piston is in the second position.

According to another embodiment, a method for moving a sliding sleeve valve in a wellbore, comprises: introducing a shifting tool in a desired wellbore zone; subjecting the shifting tool to a pre-determined hydrostatic pressure in the desired wellbore zone, wherein the shifting tool comprises at least one key, wherein the at least one key is in first position prior to and during the step of introducing the shifting tool in the desired wellbore zone; positioning the shifting tool in a sliding sleeve valve in the desired wellbore zone; allowing the at least one key to move from the first position to a second position upon location of the shifting tool in the sliding sleeve valve; and allowing the key in the second position to engage with the sliding sleeve valve to open or close the sleeve.

According to yet another embodiment, a method of activating a shifting tool in a wellbore comprises: activating a piston autonomously at a pre-determined hydrostatic pressure, wherein the shifting tool comprises the piston and at least one key positioned adjacent the piston; and allowing the key to move from the first position to a second position during the step of activating the piston.

Any discussion of the embodiments regarding the shifting tool or any component related to the shifting tool (e.g., the piston, piston restraining device, or key) is intended to apply to all of the apparatus and method embodiments. Any discussion of a particular component of an embodiment e.g., the piston, piston restraining device, or key is meant to include the singular form of the component and also the plural form of the component, without the need to continually refer to the component in both the singular and plural form throughout. For example, if a discussion involves "the key 40," it is to be understood that the discussion pertains to one key (singular) and two or more keys (plural).

Turning to the Figures, FIG. 1 depicts a well system 10. The well system 10 can include at least one wellbore 11. The wellbore 11 can penetrate a subterranean formation 19. The wellbore 11 comprises a wall 12. The subterranean formation 19 can be a portion of a reservoir or adjacent to a reservoir. The wellbore 11 can include a casing 14. The wellbore 11 can include only a generally vertical wellbore section or can include only a generally horizontal wellbore section. One or more tubing strings, for example a drill string 15, or an inner tubing string 16 can be installed in the wellbore 11. The well system 10 can further include a fluid inlet 21. The well system 10 can include two or more fluid inlets 21. The fluid inlet 21 can be used to introduce a fluid into annulus 17 located between the inside of casing 14 and the outside of drill string 15. Accordingly, the fluid inlet 21 can be located in the well system 10 such that a fluid is capable of being introduced into the annulus 17. The well system 10 can comprise at least one wellbore zone 13. The wellbore zone can be a desired wellbore zone 13 having a pre-determined hydrostatic pressure. In another embodiment, the desired wellbore zone 13 is capable of exerting a hydrostatic pressure that is greater than or equal to the value of the pre-determined hydrostatic pressure. The well system 10 can also include more than one zone, for example, the well system 10 can further include a second wellbore zone, a third wellbore zone, and so on. Each of the wellbore zones can have the same or different hydrostatic pressures. The hydrostatic pressure in each zone can correspond to the same or different pre-determined hydrostatic pressure. By way of example, the piston restraining device of a shifting tool can have a first pre-determined hydrostatic pressure that corresponds to the hydrostatic pressure of the first zone, a second piston restraining device of a second shifting tool can have a second pre-determined hydrostatic pressure corresponding to the hydrostatic pressure of the second zone, and so on. In this manner, multiple shifting tools can be introduced into multiple zones of the wellbore wherein each tool is designed to be autonomously activated at the specific hydrostatic pressure for a given zone. Cement or packers can be used to prevent fluid flow between one or more wellbore zones via an annulus 17.

It should be noted that the well system 10 illustrated in the drawings and described herein is merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing.

According to an embodiment, a shifting tool 18 can be deployed in the well system 10. The shifting tool 18 can be used to install a downhole service tool 20. The shifting tool 18 can be located or positioned within a downhole service tool 20 installed in the bottom of the wellbore 11 during well completion.

The embodiments disclosed utilize an existing downhole feature, namely, the hydrostatic pressure exerted by a column of wellbore fluid, to activate the shifting tool. The use of any extraneous and external means is therefore not required in order for the shifting tool to engage with one or more wellbore components.

The shifting tool 18 can be introduced in the desired wellbore zone 13. As discussed earlier, the wellbore 11 can be separated into one or more wellbore zones. One or more of the wellbore zones can be a desired wellbore zone. Each wellbore zone may have a known and/or calculated depth. Due to the differences in the depth of each of the wellbore zones, the hydrostatic pressure exerted by a column of the wellbore fluid can also be different at each of these wellbore zones. According to one embodiment, the shifting tool 18 can be configured to be activated at a pre-determined hydrostatic pressure. The pre-determined hydrostatic pressure required to activate the shifting tool 18 can be linked directly to the hydrostatic pressure in a desired wellbore zone 13. The pre-determined hydrostatic pressure required to activate the shifting tool 18 can, in another embodiment, be lower than the actual hydrostatic pressure in the desired wellbore zone 13.

The shifting tool 18 can be introduced or deployed in a desired wellbore zone of a multi-zone completion as well as other conventional or unconventional completion systems. A fluid communication channel may be required to be established in the desired wellbore zone 13. By way of example, the fluid communication channel can be established by shifting a sleeve or sleeves in a sliding sleeve valve (not shown). The shifting tool 18 can be run past the sliding sleeve valve. The sliding sleeve valve can have a configuration (for example, a matching recess) that is adapted to receive an expanded key whenever the shifting tool 18 and sliding sleeve valve are brought into cooperative alignment.

Figure 2A:
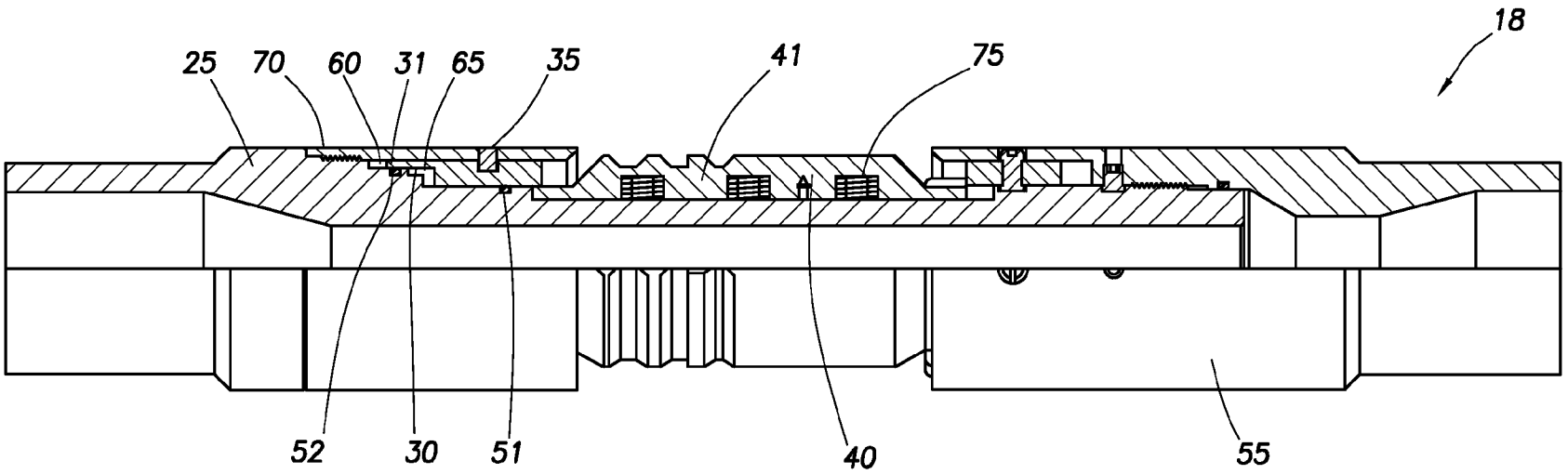
FIGS. 2A, 2B, and 2C depict a shifting tool according to different embodiments.

FIG. 2A depicts an embodiment of the shifting tool 18. As depicted, the shifting tool 18 is in a running position wherein it is capable of installing, for example, a downhole service tool (as shown in FIG. 1). Shifting tool 18 comprises a piston 30. Shifting tool 18 comprises a top sub (not shown) and bottom sub 55, which are maintained in spaced apart relation by abutting mandrel 25. A housing 70 can be disposed around the mandrel 25 and can confine key 40 between the housing and mandrel once released. The key 40 can be held in first position against the mandrel 25 by the piston 30. The key 40 is disposed adjacent and operatively coupled to piston 30. Although illustrated in FIG. 2A, where the shifting tool 18 comprises a plurality of keys 40, it is to be understood that a shifting tool comprising a single key is also within the scope of the present invention. The key 40 may include recesses or grooves 75 for containing springs and other means for biasing the key 40 radially outward or rotating. The key 40 can also contain a projection profile designed to mate with a corresponding recess profile on a downhole tool or sliding sleeve valve.

The shifting tool 18 further comprises at least one piston restraining device 35. The at least one piston restraining device 35 can be used to restrain the piston 30 in first position. The piston restraining device 35 can extend through the housing 70 into the piston 30. As used herein, the term "piston restraining device" can mean any mechanical device that is capable of restraining the piston 30 in first position. The piston restraining device can include frangible and compressible devices. Examples of frangible devices include, but are not limited to, a shear pin, a shear screw (i.e., a shear pin with treads), and a shear wire. Examples of compressible devices include, but are not limited to, a collet that snaps past a restriction, a tensile device that fails under the application of tension instead of shear, and a spring that is compressed (such as, all types of springs, coil, leaf, Bellville stacks and wave springs). The piston restraining device 35 should be capable of breaking, shearing, compressing, or decompressing at the pre-determined hydrostatic pressure. Upon breaking, shearing, compression, or decompression of the piston restraining device, the piston can move from the first position to a second position. By way of example, if the piston restraining device is a shear pin, then the shear pin can shear; if the piston restraining device is a spring, then the spring can compress; and if the piston restraining device is a collet, then the collet can decompress—all of which allow the piston to move from the first position to the second position.

According to an embodiment of the invention, the piston restraining device 35 comprises a frangible device. The frangible device can be selected such that it can break or shear under application of an axial force once the pre-determined hydrostatic pressure is reached. By way of example, the desired wellbore zone may be a wellbore zone at a depth of 30,000 feet. The existing hydrostatic pressure at 30,000 feet can be pre-determined and/or can be calculated. By way of example, the pre-determined hydrostatic pressure at 30,000 feet can be 15,000 pounds force per square inch (psi). An effective piston area can also be determined. The effective piston area can be defined as an area traversed by the piston 30 when the shifting tool 18 is subjected to the pre-determined hydrostatic pressure in a desired wellbore zone. Referring to FIG. 2C, an effective piston area, A3, can be calculated as the difference between area A2 and area A1 located between seals 52 and 51. By way of example, the effective piston area can be 1 square inches ($in^2$). As is known, pressure is expressed as the force per unit of area of the surface on contact, for example psi. Therefore, utilizing the pre-determined hydrostatic pressure value and the effective piston area value, a force rating for piston restraining device 35 can be determined. A force rating can be defined as a threshold value at which the frangible device is broken or sheared. In this example, the frangible device 35 has a 15,000 pounds force ($lb_f$) rating. Alternately, a sufficient number or a plurality of frangible devices can be selected to reach the threshold value. The number of frangible devices selected can be directly dependent on a product of the hydrostatic pressure and the effective piston area. For example, if the total force required to break or shear the frangible devices is 15,000 $lb_f$, and each frangible device has a rating of 5,000 $lb_f$, then a total of three frangible devices may be used to restrain the piston 30 in the first position 31. It is also to be understood that the force rating discussed could equally apply to the force needed to compress or decompress a compressible piston restraining device 35.

As described earlier, housing 70 can be disposed around the mandrel 25 and can confine key 40 between the housing and mandrel once released. The piston 30 can be sealably mounted on the mandrel 25 by one or more seals. By way of example, two O-ring seals 51, 52 can be used to seal the piston 30 to the mandrel 25 at diameter D1 and diameter D2, respectively, creating area A1 and A2, respectively. An atmospheric chamber 60 can be defined in the space between piston 30 and mandrel 25 by the O-ring seals 51, 52. The piston 30 is capable of slidable movement along the atmospheric chamber 60. A communication chamber 65 may be defined between a first end of the piston 30 and an interior wall in housing 70. Housing 70 can be threadably connected to the mandrel 25. According to one embodiment, the wellbore fluid circulates through the mandrel 25. Communication chamber 65 may be capable of hydrostatic communication with a tubing string. The communication chamber 65 may be exposed to the hydrostatic pressure that exists at a given wellbore zone. The seals 51, 52 can block the wellbore fluid from entering the atmospheric chamber 60. The seals 51, 52 can also shield the atmospheric chamber 60 from the hydrostatic pressure entering through communication chamber 65 while the piston 30 is in the first position 31. In this manner, when the predetermined hydrostatic pressure equals or exceeds the pressure in the atmospheric chamber, then the piston restraining device is broken, sheared, compressed, or decompressed.

Still referring to FIG. 2A, the piston 30 is configured to be autonomously activated at the pre-determined hydrostatic pressure. The piston 30 is in the first position prior to and during the step of introducing the shifting tool into the desired wellbore zone. It is to be understood that some movement of the piston can occur from the first position during running; however, the movement should not be so great such that the piston moves to the second position thereby causing the key to move to the second position. The piston 30 can be maintained in the first position 31 before the shifting tool 18 is subjected to the pre-determined hydrostatic pressure. After the piston restraining device 35 is broken, sheared, compressed, or decompressed, the piston is autonomously activated to move from the first position to the second position. The autonomous activation and movement of the piston from the first position to the second position allows the key 40 to move from the first position to a second position. Movement of the piston 30 to the second position 32 can result in the release of the key 40 from housing 70.

The key 40 can be mechanically coupled to the piston. The key 40 can be maintained in first position when the piston 30 is in a first/initial position 31. The key 40 can translate outward radially, tilt or rotate such that it moves from the first position to the second position. As illustrated in FIG. 2A, the key 40 can be maintained in a (first/initial) retracted or collapsed position 41 when the piston 30 is maintained in the first position 31. Stated differently, the key 40 can be allowed to remain in the first position 41 until the shifting tool 18 is subjected to the pre-determined hydrostatic pressure. Conveniently, upon activation by the pre-determined hydrostatic pressure, the shifting tool 18 can function as any conventional shifting tool known in the art. By way of example, the shifting tool, upon activation, can function as a Lug-Type Self-Releasing Positioning Tool marketed by Halliburton Energy Services, Inc.

Because the shifting tool 18 is subjected to the pre-determined hydrostatic pressure at a desired wellbore zone, the shifting tool 18 can be deployed to the desired wellbore zone with the key 40 maintained in the first position 41. Also, because the key 40 is maintained in the first position 41 during running into the wellbore, the shifting tool 18 can be deployed to a depth without prematurely engaging with a matching surface on one or more downhole service tool or with a sleeve in a sliding sleeve valves at least before the desired wellbore zone is reached. Moreover, because the key 40 is held in the first position, a premature sliding of the sleeves of a sliding sleeve valve can be minimized and avoided. This can prevent wear and tear of the sleeves of the sliding sleeve valves. Additionally, this can also optimize utilization of the well system and minimize downtime. According to an embodiment, the total trip time and the number of trips to move or install a downhole service tool or open or close a sliding sleeve valve can be minimized by activating the shifting tool 18 at the pre-determined hydrostatic pressure.

Figure 2B:
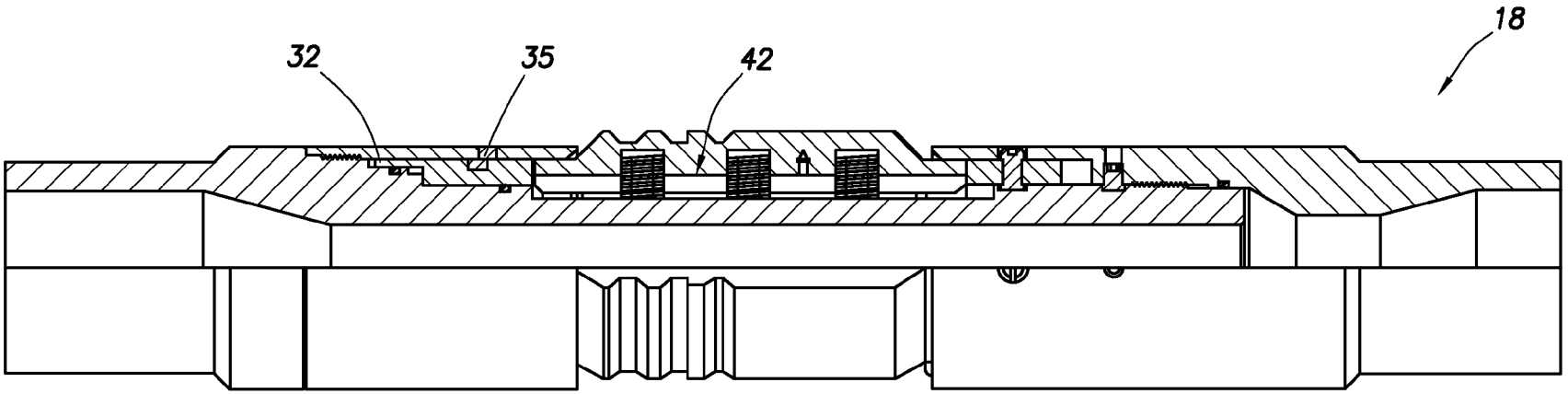
Figure 2C:
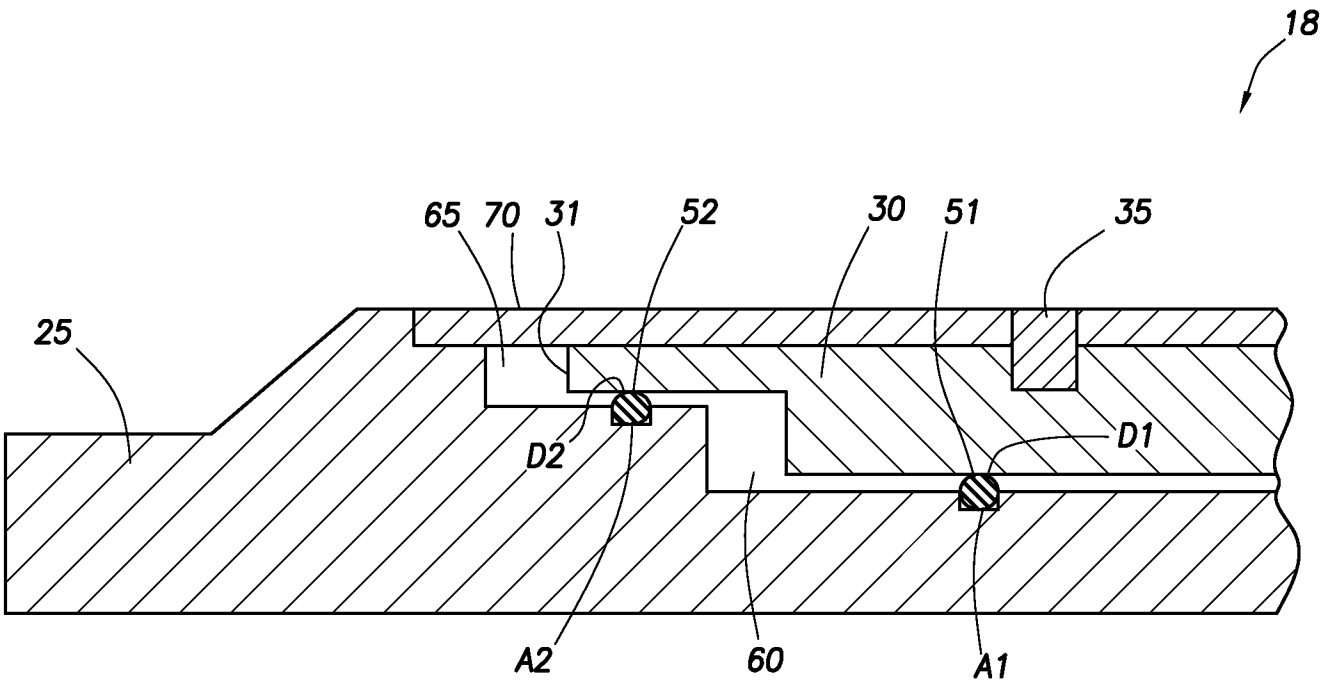

Referring now to FIG. 2B, at the pre-determined hydrostatic pressure and pressure differential, the piston restraining device 35 is broken, sheared, compressed, or decompressed. The breaking, shearing, compression, or decompression of the piston restraining device results in the shifting or displacement of the piston 30 from the first position 31 to the second position 32. As illustrated in FIG. 2B, the piston 30 can be displaced or shifted to the left (or in an upward orientation, when the shifting tool 18 is deployed in a vertical wellbore zone), that is, from the first position 31 to the second position 32. The movement of the piston 30 to the second position 32 causes the atmospheric chamber 60 to collapse. The piston 30 can be shifted in an axial direction along the atmospheric chamber 60. The piston 30 can be displaced into and come to rest within the communication chamber 65. In another embodiment, the atmospheric chamber 60 can be charged with a gas at a pre-determined pressure such that it would be automatically compressed or collapsed when the pre-determined pressure is reached or exceeded due to hydrostatic pressure. Now that the key 40 is in the second position 42, the key can be used to perform a variety of wellbore operations. Moreover, although only one piston is discussed, it is to be understood that two or more pistons can be used to move the key from the first position to the second position. According to this example, one piston could be located on one end of the key and another piston could be located at the other end of the key. Movement of both pistons from the first position to the second position would be used to move the key from the first position to the second position.

Figure 3:
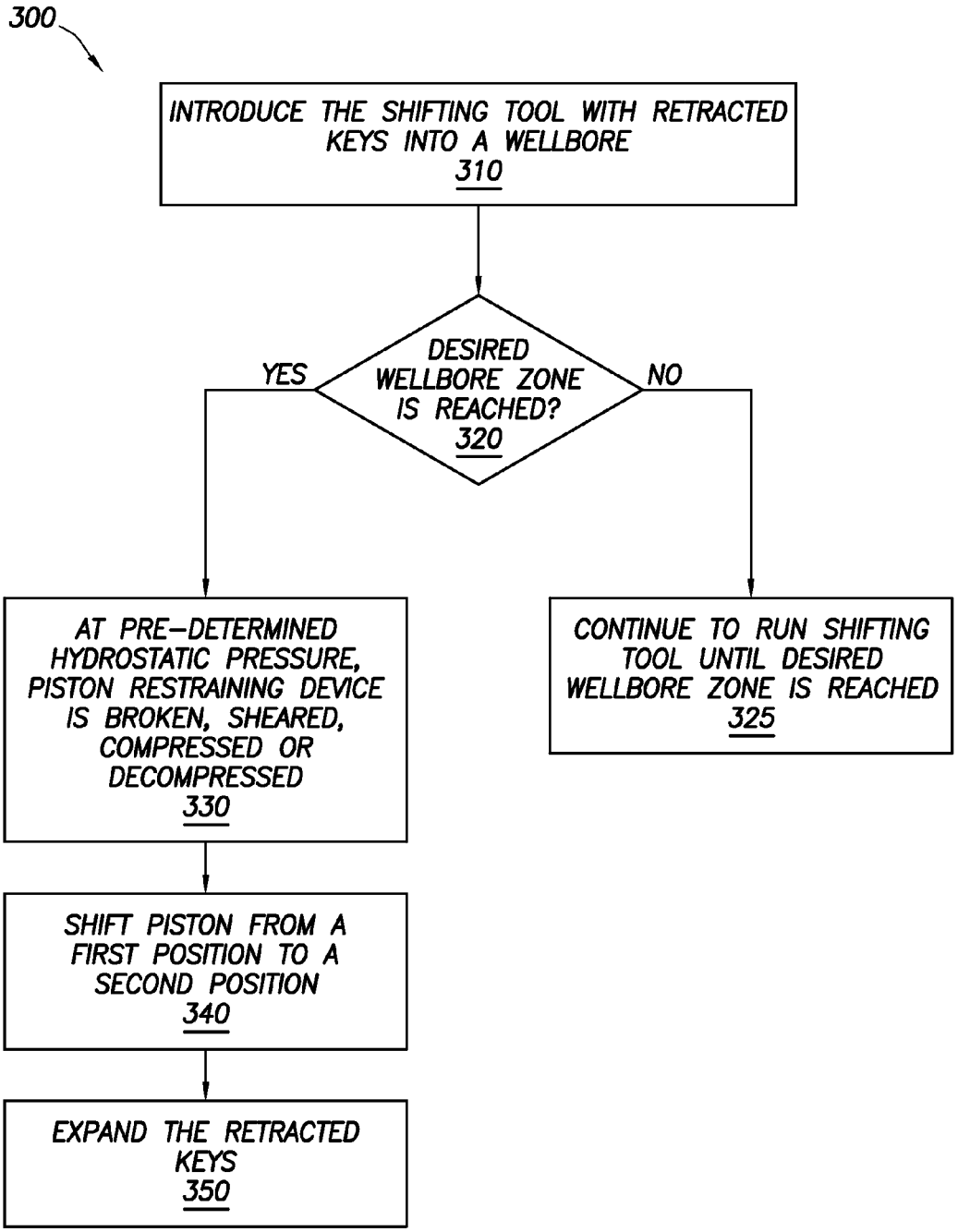
FIG. 3 depicts a flow chart for activating a shifting tool according to an embodiment.

Referring now to FIG. 3, a method for activating the shifting tool 300 according to an embodiment is illustrated. The methods can include the step of introducing or installing the shifting tool in a desired wellbore zone 310. As described in connection with FIGS. 2A-2C, the shifting tool can comprise a piston, at least one piston restraining device and at least one key. Prior to the introduction of the shifting tool in the desired wellbore zone, the key is maintained in the first position. When the key is in the first position, the shifting tool can freely pass through any downhole service tool present in the wellbore. As also previously discussed, when the key is maintained in the first position, premature opening of a sleeve or sleeves on a sliding sleeve valve can also be avoided.

The methods can include the step of determining whether the desired wellbore zone has been reached 320. As described earlier, the shifting tool can be subjected to the pre-determined hydrostatic pressure at the desired wellbore zone. A desired wellbore zone can have a pre-determined depth. A shifting tool positioned in the desired wellbore zone is subjected to the pre-determined hydrostatic pressure. If the desired wellbore zone is not reached 325, then the shifting tool is allowed to run until it reaches the desired wellbore zone. At the pre-determined hydrostatic pressure and pressure differential, the piston restraining device 330 is broken, sheared, compressed, or decompressed. The piston is shifted from the first position to a second position 340. Consequently, the retracted keys are expanded 350.

Referring back to FIG. 1, according to an embodiment, the shifting tool 18 can be used to trip or convey a downhole service tool 20 used in well completion in the wellbore 11. The shifting tool 18 and the downhole service tool 20 can be conveniently pre-assembled at the surface of the wellbore 11 and then run together as a single unit into the wellbore 11. The downhole service tool 20 can be tripped without opening any intervening sleeve or without displacing any other downhole service tool(s) located in the well conduit or located in an inner tubing string 16. This can be contrasted with conventional techniques of making separate trips to install these downhole service tools. Conventional techniques may also involve the assembly of the shifting tool and downhole service tools in the wellbore. In accordance with this and other embodiments, the shifting tool 18 can be used as an installation tool for installing a downhole service tool 20 in the wellbore 11. In other embodiments, the shifting tool 18 can also be used as a well intervention tool.

In one embodiment, after the shifting tool 18 is used to install the downhole service tool 20 in the wellbore, the shifting tool 18 can be introduced into a desired wellbore zone 13. The shifting tool 18 can be located in a sliding sleeve valve in the desired wellbore zone 13. As discussed earlier, the key 40 comprises a shifting profile configured to correspond with a mating tool or complementary matching profile on a downhole service tool or sliding sleeve valve.

The one or more embodiments can minimize rig time involved in conducting expensive fishing operations. Fishing operations may involve, by way of example, retrieval of downhole service tools.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of activating a shifting tool in a wellbore comprising:

introducing the shifting tool into a desired zone in the wellbore, wherein a pre-determined hydrostatic pressure is exerted on the shifting tool in the desired wellbore zone, and further wherein the shifting tool comprises:

a piston, wherein the piston is in a first position prior to and during the step of introducing the shifting tool into the desired wellbore zone;

at least one piston restraining device coupled to the piston;

at least one key coupled to the piston, wherein the at least one key is maintained in the first position when the piston is in the first position, wherein the piston is autonomously actuated at the pre-determined hydrostatic pressure; and a mandrel upon which the piston is slidably mounted, wherein the piston is shifted from the first position to a second position via movement of the piston along an atmospheric chamber defined between the mandrel and the piston by one or more seals; and wherein the at least one key moves to a second position when the piston is autonomously actuated to shift from the first position to the second position when the shifting tool reaches the desired wellbore zone.

2. The method according to claim 1, wherein the at least one key translates radially outward from the first position to the second position.

3. The method according to claim 1, wherein the piston is shifted from the first position to the second position after the step of introducing the shifting tool into the desired wellbore zone.

4. The method according to claim 1, wherein the at least one piston restraining device is configured to break, shear, compress, or decompresses at the pre-determined hydrostatic pressure.

5. The method according to claim 4, further comprising the step of selecting the at least one piston restraining device based on the predetermined hydrostatic pressure.

6. The method according to claim 5, wherein the at least one piston restraining device comprises a frangible device, wherein the frangible device is selected such that it has a pre-determined force rating.

7. The method according to claim 6, wherein the force rating for the frangible device is dependent on the pre-determined hydrostatic pressure and an effective piston area.

8. The method according to claim 7, wherein the effective piston area comprises an area traversed by the piston when the shifting tool is introduced in the desired wellbore zone.

9. The method according to claim 7, further comprising the step of selecting a sufficient number of frangible devices, wherein the step of selecting is dependent on the pre-determined hydrostatic pressure and the effective piston area.

10. The method according to claim 1, further comprising the step of creating a specific pressure differential across the one or more seals.

11. The method according to claim 1, wherein the key in the second position is capable of engaging with and moving a sliding sleeve of a valve, and wherein the shifting tool is located in the valve.

12. The method according to claim 11, wherein the valve is positioned in the desired wellbore zone.

13. The method according to claim 1, wherein the desired zone in the wellbore is the bottom of the wellbore.

14. The method according to claim 13, wherein the shifting tool is configured to install a completion tool at the bottom of the wellbore.

15. A method of activating a shifting tool in a wellbore comprising:

activating a piston autonomously at a pre-determined hydrostatic pressure, wherein the shifting tool comprises the piston, a mandrel, and at least one key positioned adjacent the piston, and wherein activating the piston autonomously at the pre-determined hydrostatic pressure comprises shifting the piston from a first position to a second position when the shifting tool reaches the pre-determined hydrostatic pressure via movement of the piston along an atmospheric chamber defined between the mandrel and the piston by one or more seals; and allowing the key to move from the first position to the second position during the step of activating the piston.

16. The method according to claim 15, wherein the shifting tool further comprises one or more piston restraining devices configured to break, shear, compress, or decompresses at the pre-determined hydrostatic pressure.

17. The method according to claim 16, further comprising the step of selecting the one or more piston restraining devices based on the pre-determined hydrostatic pressure and an effective piston area.

18. The method according to claim 16, wherein the breaking, shearing, compression, or decompression of the piston restraining device activates the piston.

19. The method according to claim 15, further comprising the step of introducing the shifting tool into a desired wellbore zone, wherein the shifting tool is subjected to the pre-determined hydrostatic pressure in the desired wellbore zone.

20. The method according to claim 19, wherein the piston is in the first position prior to and during the step of introducing the shifting tool into the desired wellbore zone.

21. The method according to claim 20, further comprising the step of allowing the piston to shift from the first position to a second position in the desired wellbore zone.

22. The method according to claim 15, wherein the key is capable of engaging with a mating profile provided on a downhole equipment when the key is in the second position.

23. A method for moving a sliding sleeve valve in a wellbore, comprising:

introducing a shifting tool in a desired wellbore zone;

subjecting the shifting tool to a pre-determined hydrostatic pressure in the desired wellbore zone, wherein the shifting tool comprises at least one key, wherein the at least one key is in a first position prior to and during the step of introducing the shifting tool in the desired wellbore zone;

positioning the shifting tool in a sliding sleeve valve in the desired wellbore zone;

allowing the at least one key to move from the first position to a second position upon location of the shifting tool in the sliding sleeve valve, wherein allowing the at least one key to move from the first position to the second position comprises shifting a piston of the shifting tool from a first position to a second position when the shifting tool reaches the pre-determined hydrostatic pressure in the desired wellbore zone via movement of the piston along an atmospheric chamber defined between a mandrel and the piston by one or more seals; and allowing the key in the second position to engage with the sliding sleeve valve to open or close the sleeve.

24. A shifting tool for use in a wellbore comprising:

a piston configured to be autonomously activated at a pre-determined hydrostatic pressure, wherein a desired zone in the wellbore exerts a hydrostatic pressure greater than or equal to the pre-determined hydrostatic pressure;

at least one piston restraining device coupled to the piston, wherein the piston restraining device is configured to break, shear, compress, or decompress at the pre-determined hydrostatic pressure;

at least one key coupled to the piston, wherein the at least one key is operatively maintained in a first position when the piston is in the first position;

a mandrel for slidably mounting the piston; and an atmospheric chamber defined between the piston and the mandrel by one or more seals, wherein the pre-determined hydrostatic pressure creates a specific pressure differential across the one or more seals, and wherein the pressure differential breaks, shears, compresses, or decompresses the at least one piston restraining device, and wherein the piston is axially shifted along the atmospheric chamber, wherein the piston is in the first position prior to and during introduction of the shifting tool in the desired wellbore zone, wherein the breaking, shearing, compression, or decompression of the at least one piston restraining device at the pre-determined hydrostatic pressure shifts the piston from the first position to a second position, and wherein the at least one key is released from the first position when the piston is in the second position.

25. The shifting tool according to claim 24, wherein the at least one piston restraining device comprises a pin, wherein the pin has a pre-determined force rating that is less than or equal to the pre-determined hydrostatic pressure.

* * * * *